US005932672A

United States Patent [19]

Willis et al.

[11] Patent Number: 5,932,672

[45] Date of Patent: Aug. 3, 1999

[54] FIBRE REACTIVE POLYMERS

[75] Inventors: Colin R Willis; Stuart A Brewer, both of Salisbury, United Kingdom

[73] Assignee: The Secretary of State for Defence in Her Britanic Majesty's Goverment of the United Kingdom of Great Britain and Northern Ireland of Defence Evaluation & Research Agency, United Kingdom

[21] Appl. No.: 09/043,769

[22] PCT Filed: Sep. 9, 1996

[86] PCT No.: PCT/GB96/02220

§ 371 Date: Mar. 27, 1998

§ 102(e) Date: Mar. 27, 1998

[87] PCT Pub. No.: WO97/13024

PCT Pub. Date: Apr. 10, 1997

[30] Foreign Application Priority Data

Sep. 29, 1995 [GB] United Kingdom ..... 9519824

[51] Int. Cl.[6] ..... C08F 12/30

[52] U.S. Cl. ..... 526/243; 526/248; 526/249

[58] Field of Search ..... 526/243, 248, 526/249

[56] References Cited

U.S. PATENT DOCUMENTS

| | | | |
|---|---|---|---|
| 3,916,053 | 10/1975 | Sherman et al. . | |
| 4,032,495 | 6/1977 | Perronin et al. . | |
| 4,043,964 | 8/1977 | Sherman et al. . | |
| 4,507,324 | 3/1985 | Salvador et al. . | |
| 4,590,236 | 5/1986 | König et al. . | |
| 4,636,545 | 1/1987 | König et al. . | |
| 4,709,074 | 11/1987 | Bathelt et al. . | |
| 4,997,893 | 3/1991 | Süling et al. . | |
| 5,171,803 | 12/1992 | Walton et al. | 526/243 |

FOREIGN PATENT DOCUMENTS

| | | |
|---|---|---|
| 221 046 | 5/1987 | European Pat. Off. . |
| 2 291 439 | 1/1996 | United Kingdom . |
| 92 18332 | 10/1992 | WIPO . |

*Primary Examiner*—Bernard Lipman
*Assistant Examiner*—N. Sarofim
*Attorney, Agent, or Firm*—Nixon & Vanderhye

[57] ABSTRACT

Permanently stain resistant nylon and cellulosic fibers, and a method to impart permanent stain resistance to polyamide or cellulosic fibers, by covalently binding a stain resistant composition to a linking compound that has been covalently attached to the fiber are disclosed. This invention represents a significant advance in the art of textile treatments in that the covalently linked stain resist treatment is not removed after a series of alkaline shampooins. This invention is particularly useful in the preparation of commercial grade carpets for heavy traffic areas that will not lose their stain resistance after frequent shampooing.

6 Claims, 1 Drawing Sheet

FIBRE REACTIVE POLYMERS

Figure 1:
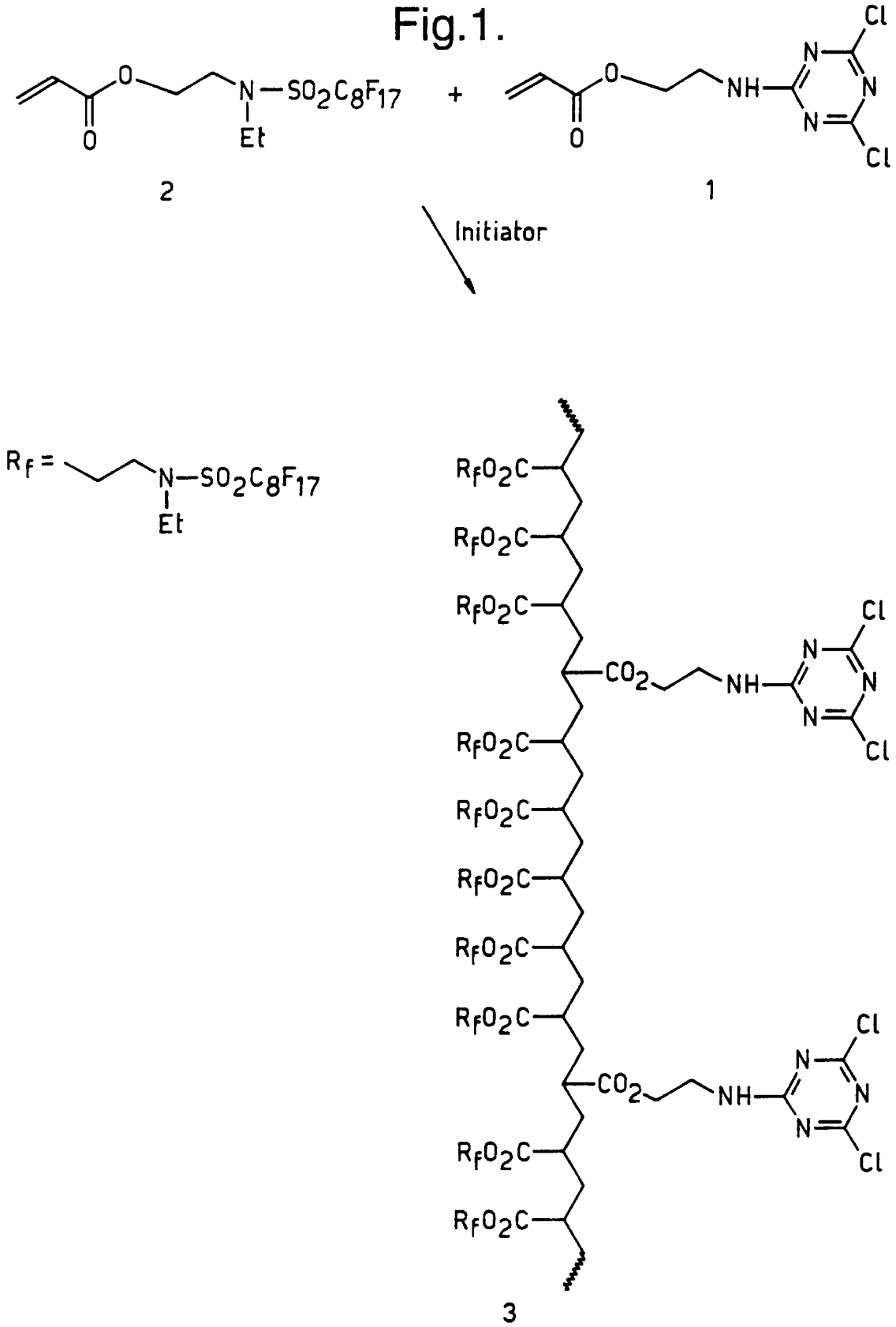

The present invention relates to a group of polymers suitable for binding to cellulose or woollen based material and is useful for the treatment of cloth, linen fabric and the like.

The durability of certain functional treatments (e.g. water or oil repellency) on cellulose based fabrics can by improved by the addition of cross-linkable resins to their formulations. Depending on the type of resin employed, fixation to the cloth may occur under acidic conditions (eg with dimethyloldihydroxyethylene urea) or under neutral conditions (eg with a blocked polyisocyanate).

The use of certain groups, for example triazines, to bind molecules to cellulose based, and other, materials is known from the chemistry of reactive dyes. For example, the 2,4-dichloro-6-aminotriazyl group is used to bind a family of dyes, known commercially as Procion dyes, to cellulose materials (see for example, The Chemistry of Synthetic Dyes, Vol. IV—Reactive Dyes, K Venkataraman Ed., Academic Press.).

The use of fluoroalkyl compounds to improve the oil and water repellency of articles is described, for example, in GB 1,102,903. These compounds are non-polymeric and the invention described therein requires the use of organic solvents whereas the current invention may be carried out in aqueous solvents.

Whilst resin treatments can improve the durability of certain finishes and impart dimensional stability and durable press properties to fabrics, the acid catalysts required to bring about the cross-linking reactions can damage acid sensitive cloth such as cotton. Moreover, excessive cross-linking can also lead to a reduction in abrasion resistance (see for example Textile Chemist and Colorist, 1995, Vol. 27, page 17, R J Harper and Melliand Textilber., 1986, Vol. 67, p.E61-5, J. Hearle). Problems also arise with resins that contain formaldehyde and this has prompted considerable research into the development of cross linking agents that do not contain this compound (see for example Textile Res. J., 1994. Vol. 64, page 247, N. R. Bertoniere et al).

According to this invention, a polymer for the treatment of materials is characterised by a plurality of side groups of general formula —A—Az, where:

A=$(CH_2)_n$, wherein non adjacent $CH_2$ groups may be replaced by O, $CO_2$, OCO, $OCO_2$, or phenylene and n may have any integral value from 0 to 16, and Az is selected from:

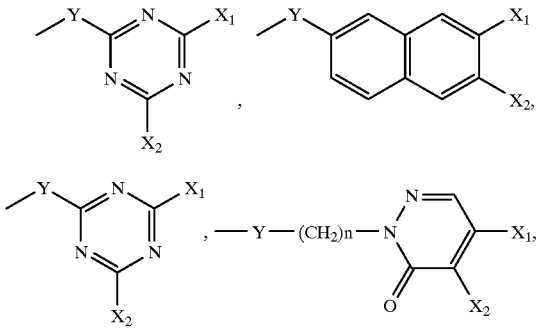

-continued

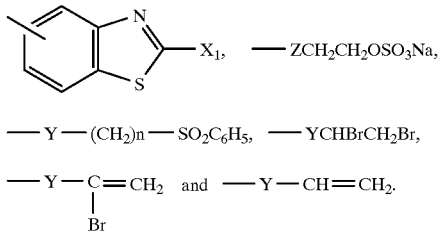

where $X_1$, $X_2$ etc are independently selected from halogen, —NHR, —$SO_2CH_3$, Alkl, Aryl, O—Alkyl or —O—Aryl and at least one of $X_1$, $X_2$ etc per group Az is halogen;

Y=—NH—, —NR—(R=Alkyl), —NHCO—, —O—, or —S— and

Z=—$SO_2$NH— or —$SO_2$—

In a preferred embodiment, the polymer also contains fluorine bearing side groups.

In a further preferred embodiment, the polymer also contains side groups bearing $R_f$ where:

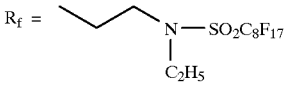

In a further preferred embodiment, the polymer contains the side group —$CO_2R_f$.

In a further preferred embodiment the polymer has the repeat unit:

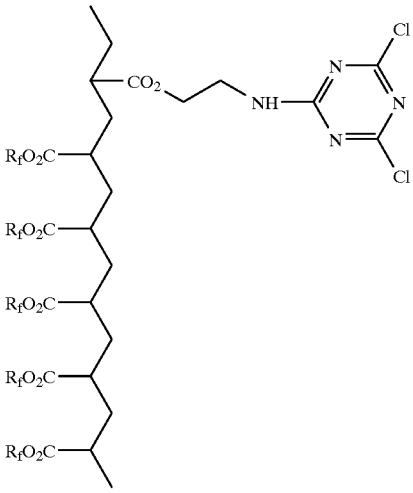

According to a second aspect of the invention a material is provided with improved physical properties by virtue of treatment of said material with the polymer of the first aspect of the invention.

According to a third aspect of the invention, a method is provided of treating a material with the polymer of the first aspect of the invention. Preferrably the material is treated in an aqueous solution.

Durability of the polymers may be further improved by the addition of polyhydric alcohols.

The invention will now be described, by way of non-limiting example, with reference to FIG. 1 which shows the reaction scheme during the production of a polymer used in a particular embodiment of the invention. Although the following example relates to the treatment of fabrics to improve their oil and water repellent properties, this should not be seen as limiting. The invention may be used inother situations where treatment of material with a polymer may improve physical properties eg. abrasion resistance or fire rerdance.

EXPERIMENTAL

Referring to FIG. 1, a solution of 1250 parts surfactant FC 126 (available from Fluorochem Ltd.) in 60000 parts distilled water was added to a stirred solution containing 1050 parts 2,4-dichloro-6-(N-(2-acrylyl)ethylamnino)-s-triazine 1,22500 parts 2-(N-ethylperfluorooctylsulphonamide)ethyl acrylate 2, and 125 parts octanethiol ($C_8H_{17}SH$) in acetone. The mixture was deaerated with argon and then warmed to 55° C. before addition of 125 parts potassium persulphate. The temperature was increased to 65° C. and stirring maintained under a blanket of argon for 20 hours. The resulting dispersion of polymer 3 was allowed to cool, filtered and stored (total solids content=20%).

Treatment of Cotton Fabrics using Formulation of Polymer 3.

Sample A: The formulation of polymer 3 obtained from the above experimental procedure was diluted to 30 g/litre with a 7.5% w/v sodium carbonate solution. The cotton fabric was irnrnersed in this solution, pad mangled to a 150% wet pick-up, and cured at 150° C. for 10 minutes.

Samiple B: Cotton fabric was treated in an identical manner to that described for sample A, except that the polymer formulation was diluted with distilled water rather than sodium carbonate solution.

Prior to repellency tests and laundering, the cloth samples were washed with detergent (Tepol, TM) and rinsed with water. Repellency rating are in accordance with AATCC Test Method 118-1978, (see AATCC Technical Manual 55, p242 (1979)). Tables 1 and 2 show the results of oil (O) and water (W) repellancy tests carried out on samples A and B.

TABLE 1

| | Sample A | Sample B |
|---|---|---|
| Initial | O5 W5 | O5 W5 |
| 5 hr Soxhlet with trichloroethylene | O5 W5 | O2 W4 |
| 3 hr Soxhlet with benzotrifluoride | O4 W4 | O3 W3 |

TABLE 2

| | Sample A | Sample B |
|---|---|---|
| Initial | O5 W5 | 05 W5 |
| 10 min boil | O5 W5 | 02 W3 |
| 10 min boil | O5 W5 | W |
| 20 min boil | O4 W4 | W |
| 45 min boil | O4 W4 | |

Tables 1 and 2 show that a more durable oil and water repellent finish results when base is included in the formulation. This is consistent with reaction between cellulosate anions in the cotton (formed by reaction of hydroxyl groups with the base) and the fibre reactive groupings on the polymer.

We claim:

1. A polymer for the treatment of materials, characterised by a plurality of side groups of general formula —A—Az, where:

A=$(CH_2)_n$, wherein non adjacent $CH_2$ groups may be replaced by O, $CO_2$, OCO, $OCO_2$, or phenylene and n may have any integral value from 0 to 16; and Az is selected from:

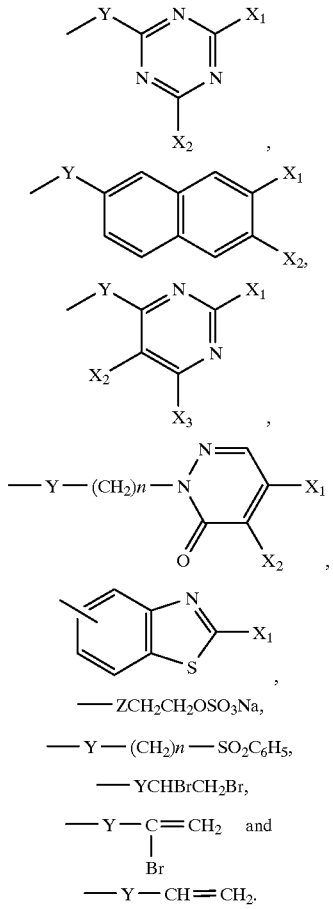

where $X_1$, $X_2$ etc are independently selected from halogen, —NHR, —$SO_2CH_3$, Alkyl, Aryl, O—Alkyl or —O—Aryl and at least one of $X_1$, $X_2$ etc per group Az is halogen;

Y=—NH—, —NR—(R=Alkyl), —NHCO—, —O—, or —S— and

Z=—$SO_2$NH— or —$SO_2$— and further containing fluorine bearing side groups.

2. The polymer of claim 1, containing side groups bearing $R_f$ where:

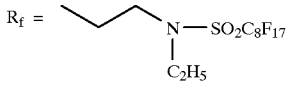

3. The polymer of claim 2, containing the side group —$CO_2R_f$.

4. The polymer of claim 3, having the repeat unit:
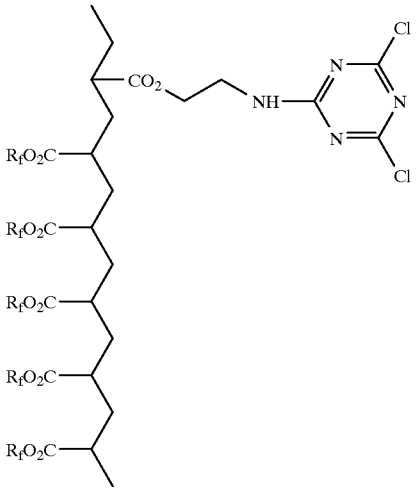
5. A material characterised by treatment with a polymer as described in claim 1.
6. A method of treating a material characterised by the use of an aqueous formulation of the polymer described in claim 1.
* * * * *